US009638055B2

(12) United States Patent
Bellino et al.

(10) Patent No.: US 9,638,055 B2
(45) Date of Patent: May 2, 2017

(54) COOLING HOLE CLEANING METHOD

(71) Applicant: General Electric Company, Schenectady, NY (US)

(72) Inventors: Mark Carmine Bellino, Greenville, SC (US); Mark Lawrence Hunt, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/349,283

(22) Filed: Nov. 11, 2016

(65) Prior Publication Data

US 2017/0058695 A1 Mar. 2, 2017

Related U.S. Application Data

(62) Division of application No. 13/745,136, filed on Jan. 18, 2013, now Pat. No. 9,523,287.

(51) Int. Cl.

| | |
|---|---|
| ***B08B 9/00*** | (2006.01) |
| ***F01D 25/00*** | (2006.01) |
| ***F01D 25/12*** | (2006.01) |
| ***F04D 29/70*** | (2006.01) |

(Continued)

(52) U.S. Cl.

CPC ..... *F01D 25/002* (2013.01); *B08B 9/0321* (2013.01); *F01D 25/12* (2013.01); *F04D 29/582* (2013.01); *F04D 29/701* (2013.01); *F05D 2220/31* (2013.01); *F05D 2220/32* (2013.01)

(58) Field of Classification Search

None

See application file for complete search history.

(56) References Cited

U.S. PATENT DOCUMENTS

| | | | | |
|---|---|---|---|---|
| 4,317,685 A * | 3/1982 | Ahuja | C23G 1/20 134/2 |
| 5,507,306 A * | 4/1996 | Irvine | B08B 9/00 134/144 |
| 2008/0006301 A1* | 1/2008 | Garry | B08B 3/024 134/22.18 |

FOREIGN PATENT DOCUMENTS

JP 09-158702 * 6/1997

OTHER PUBLICATIONS

Machine translation of JP09-158702 by Masaki et al., published Jun. 17, 1997.*

* cited by examiner

*Primary Examiner* — Michael Kornakov
*Assistant Examiner* — Ryan Coleman
(74) *Attorney, Agent, or Firm* — Ernest G. Cusick; Hoffman Warnick LLC

(57) ABSTRACT

Blockages of turbomachine cooling circuit cooling holes resulting from coating processes can be removed by introducing a cleaning agent into the cooling circuit. The cooling circuit can be connected to a cleaning agent supply under pressure, adding force on the blockage to chemical action by the cleaning agent. The cleaning agent is chemically reactive with the coating material and substantially chemically non-reactive with the underlying material of the cooling circuit and other parts of the turbomachine. A neutralization agent can also be introduced to reduce toxicity and/or action of the cleaning agent. A turbomachine cooling hole cleaning method includes introducing a cleaning agent into a cooling circuit of a turbomachine part, pressurizing the cleaning agent in the cooling circuit until a first defined condition is met, and introducing a neutralization agent to the turbomachine part while the cleaning agent is applied to the cooling circuit.

4 Claims, 4 Drawing Sheets

(51) Int. Cl.
*F04D 29/58* (2006.01)
*B08B 9/032* (2006.01)

COOLING HOLE CLEANING METHOD

CROSS-REFERENCE TO RELATED APPLICATION

This application is a divisional application of co-pending U.S. patent application Ser. No. 13/745,136, filed Jan. 18, 2013, which is hereby incorporated by reference in its entirety.

BACKGROUND OF THE INVENTION

The disclosure relates generally to rotating machinery or turbomachinery, such as gas and/or steam turbines, compressors, and/or machines including such turbines and/or compressors. More particularly, the disclosure relates to the removal of material deposited over and/or in cooling holes of a part, such as a combustor jacket.

During manufacture, repair, and/or rehabilitation of gas turbines, coatings are applied to some parts. For example, in turbomachinery, particularly in gas turbines, a thermal barrier coating (TBC) can be applied to protect underlying material of the parts to which the TBC is applied from heat. A TBC can include a ceramic layer, which can include a variety of ceramic materials, the most commonly used of which is currently yttria-stabilized zirconia (YSZ). In addition, a typical TBC can include a metallic bonding layer applied to the underlying material of the part, and a thermally grown oxide layer on the metallic bonding layer, to which the ceramic layer is applied.

When such a coated turbomachine part includes cooling holes, the cooling holes can become partially or completely occluded, and the coating(s) can also form deposits on interior portions of passages leading to the cooling holes. Typically, portions of the part on which the coating is not desired are covered with a masking agent, the coating is applied to the part, and overspray is removed by mechanical grinding. The masking agent can then be removed, such as by abrasion and/or burning or other chemical means.

BRIEF DESCRIPTION OF THE INVENTION

Embodiments of the invention disclosed herein may take the form of a turbomachine cooling hole cleaning apparatus having a supply of a fluid that includes a cleaning agent. A pressurization apparatus can be configured for fluid communication with the cleaning agent supply and with a cooling circuit of a turbomachine part, the cooling circuit including at least one cooling passage with a respective cooling hole. The pressurization apparatus can further be configured to introduce cleaning agent into the cooling circuit from the supply into the cooling circuit.

Embodiments of the invention may also take the form of a turbomachine cooling hole cleaning method including introducing a cleaning agent into a cooling circuit of a turbomachine part, pressurizing cleaning agent in the cooling circuit until a first defined condition is met, and introducing a neutralization agent to the turbomachine part while the cleaning agent is applied to the cooling circuit.

Embodiments of the invention may further take the form of a turbomachine cooling hole cleaning apparatus including a conduit configured for connection to and fluid communication with a cooling circuit of a turbomachine part that includes at least one cooling passage with a respective cooling hole. A supply of a cleaning agent can be configured for fluid communication with the conduit, and a pressurization apparatus can be configured for fluid communication with at least the conduit and the supply. In addition, the pressurization apparatus can be configured to send cleaning agent from the supply into the conduit under pressure.

Other aspects of the invention provide apparatus and/or methods of using and/or generating each, which can include and/or implement some or all of the actions described herein. The illustrative aspects of the invention are designed to solve one or more of the problems herein described and/or one or more other problems not discussed.

BRIEF DESCRIPTION OF THE DRAWINGS

These and other features of the disclosure will be more readily understood from the following detailed description of the various aspects of the invention taken in conjunction with the accompanying drawings that depict various aspects of the invention.

It is noted that the drawings may not be to scale. The drawings are intended to depict only typical aspects of the invention, and therefore should not be considered as limiting the scope of the invention. In the drawings, like numbering represents like elements between the drawings.

The detailed description explains embodiments of the invention, together with advantages and features, by way of example with reference to the drawings.

DETAILED DESCRIPTION OF THE INVENTION

Embodiments of the invention disclosed herein can take advantage of an existing fluid distribution system in a turbomachine part to remove blockages of cooling holes and deposits from cooling passages resulting from application of a coating to the part, such as a thermal barrier coating (TBC). As used herein, "cooling holes" can include any opening of a cooling circuit of a turbomachine part through which fluid can leak, and "cooling passages" can include and line, conduit, or other passage that is part of the cooling circuit. As discussed above, a typical TBC can include a metallic bonding layer applied to the part, a thermally grown oxide layer derived from the metallic bonding layer, and a ceramic or other suitable material applied to the oxide layer. As also discussed above, a widely used ceramic material can include yttria-stabilized zirconia (YSZ), though other materials have been used in the past, can and are used now, and may be used in the future. A supply of cleaning agent can be substituted for a supply of cooling fluid in a cooling circuit in which the deposits and blockages occur. The cleaning agent can include a compound that is chemically reactive with the coating. For example, where YSZ is employed, the cleaning agent can include an acid, which can be used to remove metallic bonding layer material(s), and a base, which can be used to remove additional TBC material(s). By introducing cleaning agent, particularly under pressure, into the cooling circuit, the cleaning agent can act chemically and physically to remove deposits and blockages, and, particularly when a neutralization agent is introduced, such as by spraying and/or immersion, application of a masking agent may not even be required, saving time, material, and cost.

Figure 1:
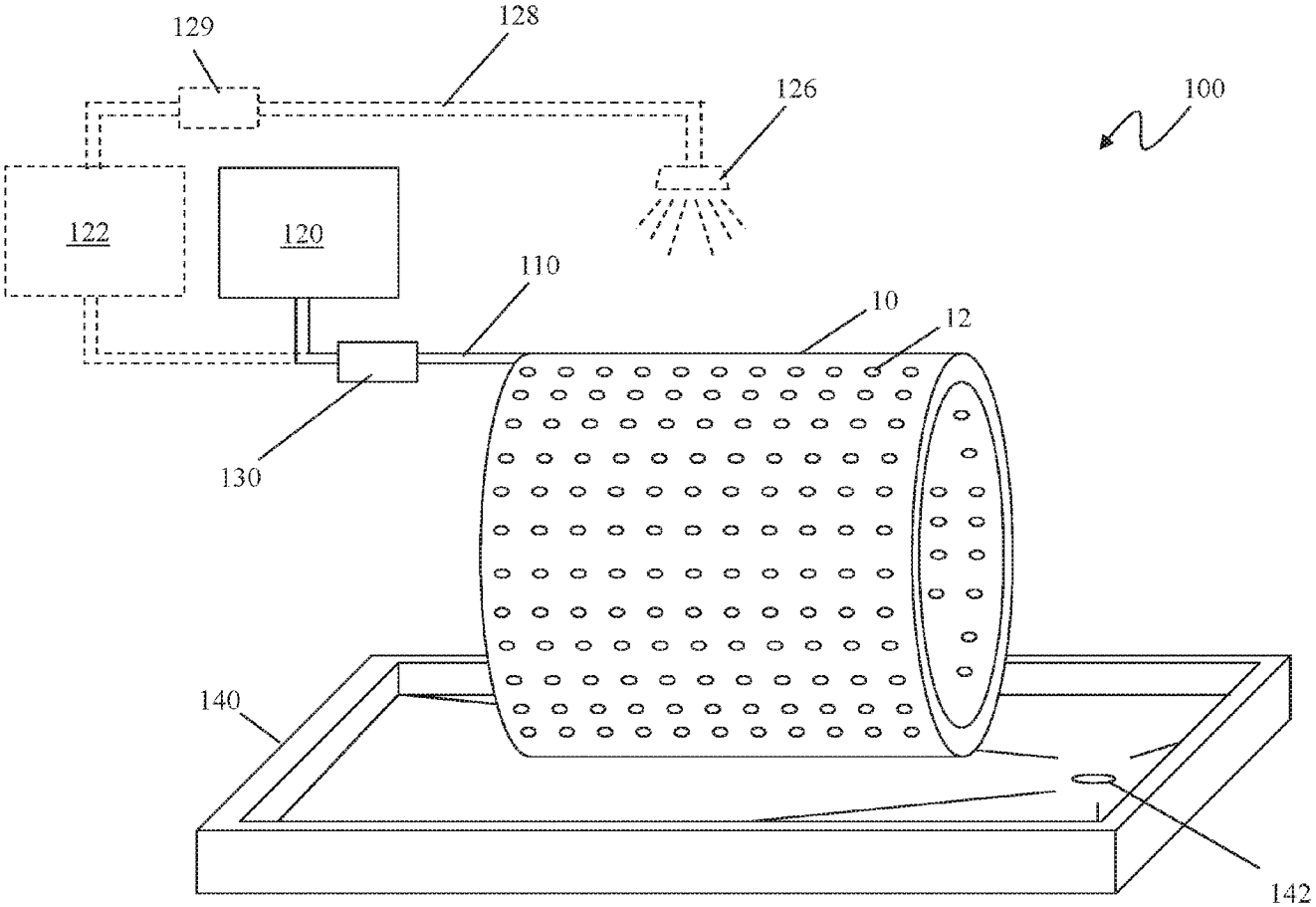
FIG. 1 shows a schematic diagram of an example of a part and apparatus with which embodiments of the invention disclosed herein may be employed.

With reference to FIG. 1, a turbomachine part 10 can include at least one cooling hole 12 that can become blocked. With additional reference to FIG. 2, cooling hole(s) 12 can be part of a cooling circuit 14 of turbomachine part 10. During normal operation, cooling circuit 14 can be configured to convey fluid, such as a cooling fluid, from a supply 16 to an internal passage 18 on an interior of a wall 20 of turbomachine part 10. While fluid supply 16 is depicted in such a way as might be interpreted as a tank or the like, it should be understood that fluid supply 16 can take the form of a line to a compressor stage or any other source of fluid in a turbomachine in which turbomachine part 10 would ordinarily be installed and/or to which cooling circuit 14 might be connected. A plurality of cooling passages 22 can further convey fluid from internal passage 18 to an exterior of turbomachine part 10 via cooling hole(s) 12 as part of cooling circuit 14. However, a coating 24 applied to turbomachine part 10 can result in blockage 26 of a cooling hole 12 or multiple holes 12, as well as narrowing cooling passage(s) 22 with deposit(s) 28 along a wall of cooling passage(s) 22.

Figure 2:
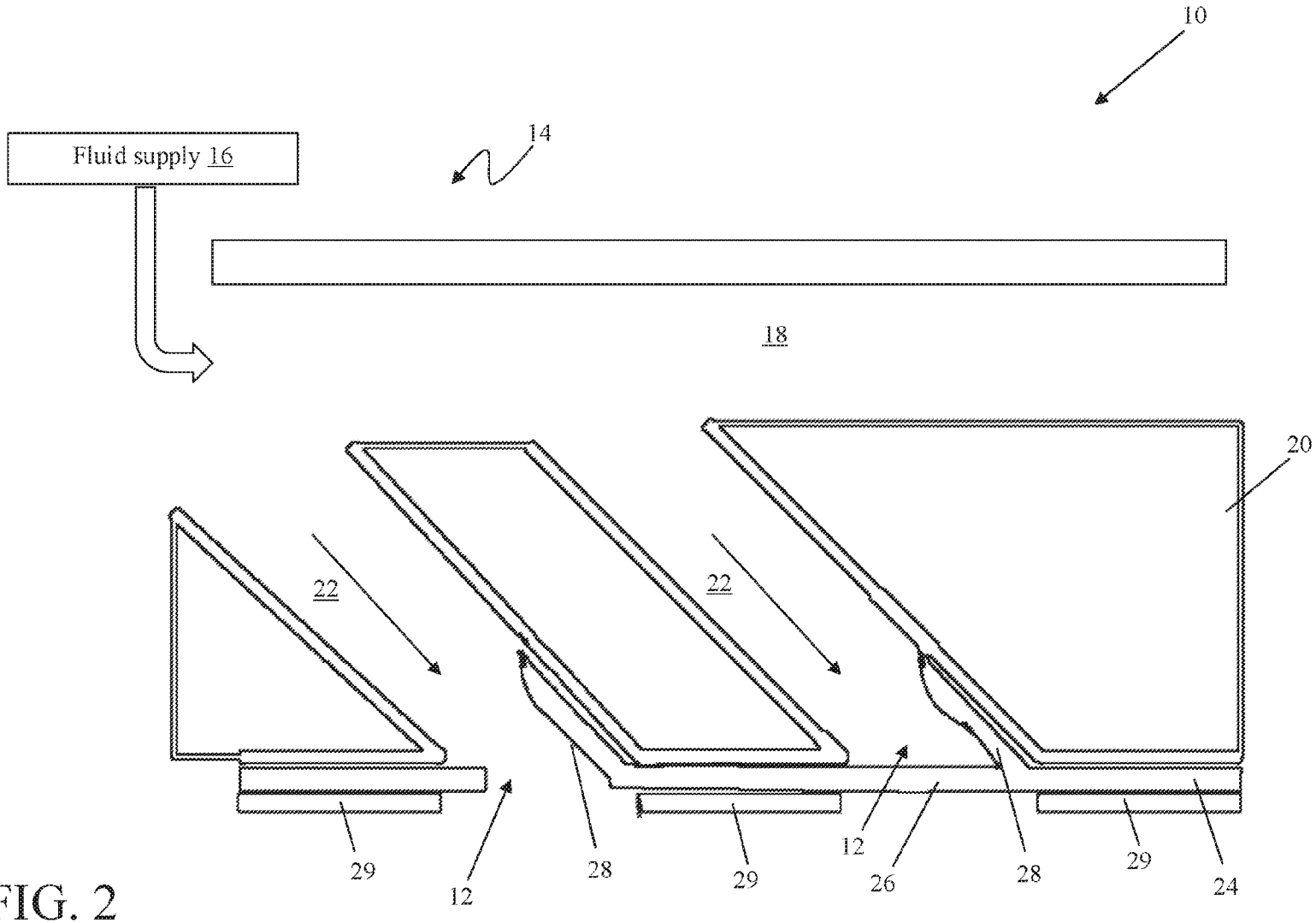
FIG. 2 shows a schematic cross sectional view of a coated part being cleaned according to embodiments of the invention disclosed herein.

Referring again to FIG. 1, as well as FIG. 2, noting that not all reference numerals used herein are necessarily shown in both FIGS. 1 and 2, embodiments can introduce a cleaning agent into cooling circuit 14. For example, a conduit 110 can be connected to cooling circuit 14 and to a cleaning agent supply 120, such as a reservoir of cleaning agent. Cleaning agent can then be forced into cooling circuit 14 using a pressurization apparatus 130, such as a pump. As pressurized cleaning agent enters cooling circuit 14, it can enter internal passage 18 and cooling passage(s) 22. Cleaning agent can then act on blockage(s) 26 chemically and physically as a result of pressure exerted on blockage(s) 26. In addition, cleaning agent can act on deposit(s) 28, primarily chemically, but also physically as a result of erosion as cleaning agent passes deposit(s) 28. Cleaning agent can exit cooling circuit 14 through hole(s) 12 and/or other openings, so embodiments can include a catchment 140 to capture exiting cleaning agent. Catchment 140 can include a drain 142, which can divert captured cleaning agent to a container or other destination for disposal and/or reuse. In embodiments, neutralization agent can be introduced into cooling circuit 14 to reduce toxicity and/or hostile action of any cleaning agent remaining in cooling circuit 14. For example, a neutralization agent supply 122 can be connected to conduit 110 and/or pressurization apparatus 130 so that neutralization agent can be fed into cooling circuit 14. To avoid accidental removal of coating 24 from areas in which it is desired, a masking agent 29 (FIG. 2), such as a coating, can be applied before cleaning agent is supplied to cooling circuit 14 so that cleaning agent escaping cooling circuit 14, such as through cooling hole(s) 12, does not react with coating 24 that is covered by masking agent 29.

Figure 3:
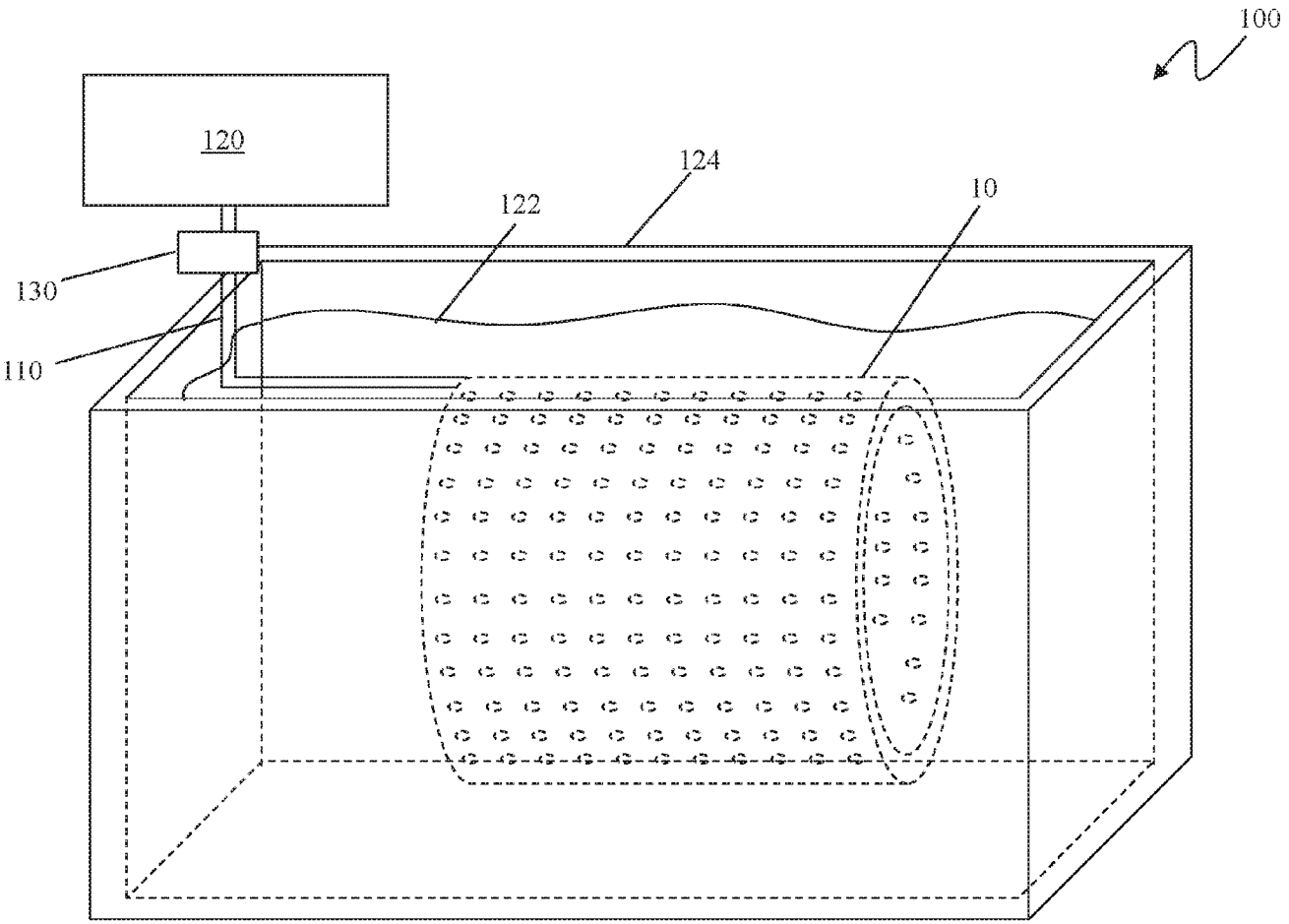
FIG. 3 shows a schematic diagram of an example of a part and apparatus with which embodiments of the invention disclosed herein may be employed.

With reference to FIG. 3, embodiments of the invention disclosed herein can employ a different approach to avoiding accidental removal of coating 24 that can avoid the use of masking agents entirely. More specifically, neutralization agent supply 122 can be placed in a tank 124 or the like into which turbomachine part 10 can be immersed. With turbomachine part 10 so immersed, cleaning agent can be supplied to cooling circuit 14, and any cleaning agent that escapes through cleaning holes 12 is neutralized as it escapes into neutralization agent supply 122. In embodiments, rather than immersing turbomachine part 10, neutralization agent can be sprayed or otherwise applied to turbomachine part 10 as cleaning agent is supplied to cooling circuit 14. For example, as seen in FIG. 1, one or more spray heads 126 could be connected to neutralization agent supply 122 via conduit(s) or line(s) 128 so that neutralization agent can be sprayed onto turbomachine part 10, particularly during supply of cleaning agent to cooling circuit 14.

Figure 4:
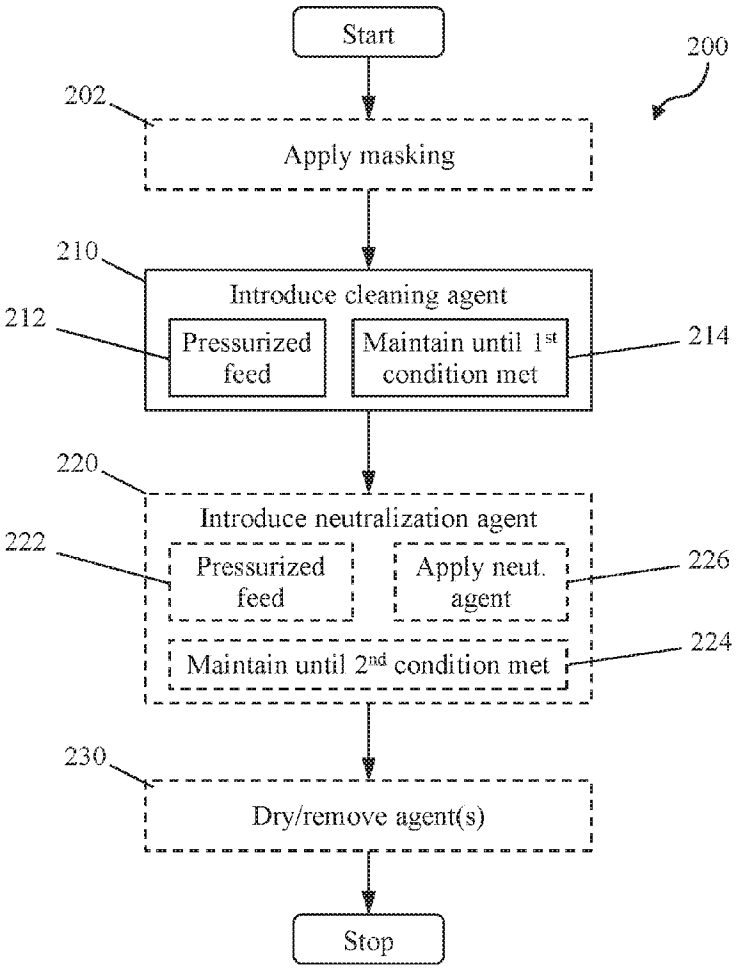
FIG. 4 is a schematic flow diagram of an example of a cooling hole cleaning method according to embodiments of the invention disclosed herein.

An example of a method 200 of cleaning cooling holes and/or passages of a turbomachine part according to embodiments is shown in FIG. 4. In embodiments, a masking agent can be applied (block 202) prior to cleaning to protect coating in areas in which the coating is desired. Cleaning can begin by introducing cleaning agent to turbomachine part (block 210), such as by using a pressurized feed (block 212) of cleaning agent from a supply, through a conduit, and into cooling circuit 14. Using a pressurized feed can include, for example, running a pump connected to the cleaning agent supply and to the conduit. The cleaning agent can be maintained in the cooling circuit until a defined condition has been met (block 214), such as an elapsed time, until all blockages and/or deposits are removed, or until some other condition has been met as may be suitable and/or desired. Embodiments can also include introducing a neutralization agent (block 220) to protect coating(s) in areas in which the coating(s) is wanted to reduce toxicity of the cleaning agent, and/or to reduce toxicity and/or action of cleaning agent remaining in and/or escaping from the cooling circuit. Neutralization agent can be introduced, for example, from a neutralization agent supply using a pressurized feed (block 222), such as by using the same pressurized feed used to introduce cleaning agent into the cooling circuit. As with cleaning agent, neutralization agent can be maintained in the cooling circuit until a defined condition is met (block 224), such as elapsed time, a chemical property of fluid exiting the cooling system reaching a defined value, and/or another condition as may be desired and/or appropriate. Rather than sending neutralization agent through the cooling circuit, embodiments can apply neutralization agent to the part being cleaned (block 226), such as by spraying neutralization agent onto the part and/or by immersing the part in neutralization agent. In addition, embodiments can include drying and/or removing cleaning and/or neutralization agent from the part (block 230).

Using embodiments of the invention, blockages and/or deposits in a cooling circuit of a turbomachine part can be removed more quickly and effectively by virtue of the combined chemical and physical action of cleaning agent fed into the cooling circuit. In addition, the use of neutralization agent, whether by feeding through the cooling circuit, external application by spraying, and/or by immersion, can reduce risk of removing coating in areas where the coating is desired, as well as reduce action/toxicity of the cleaning agent as it escapes the turbomachine part. A single application of masking can be used until blockage and deposit removal is complete, which can also save time, cost, and effort. Further, it may be easier to determine when a cooling hole has been cleared, since fluid will begin to exit through the cooling hole when the blockage has been breached and/or removed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A turbomachine cooling hole cleaning method comprising:

introducing a cleaning agent into a cooling circuit of a turbomachine part, the cooling circuit having at least one cooling passage with a respective cooling hole;

pressurizing the cleaning agent in the cooling circuit until a first defined condition is met, wherein the pressurizing includes connecting a first pressurization apparatus to a cleaning agent supply and to the cooling circuit and operating the first pressurization apparatus until the first defined condition is met; and introducing a neutralization agent to the turbomachine part while the cleaning agent is applied to the cooling circuit, wherein the introducing of the neutralization agent includes using a conduit to connect a neutralization agent supply to a sprayer head configured to spray neutralization agent onto the turbomachine part, wherein one of the cleaning agent or the neutralization agent includes an acid, and the other of the cleaning agent or neutralization agent includes a base.

2. The method of claim 1, further comprising placing a catchment under the turbomachine part to capture fluid exiting the cooling circuit.

3. The method of claim 1, wherein the cleaning agent includes a compound that is chemically reactive with a coating on the turbomachine part and substantially chemically non-reactive with an underlying material of the turbomachine part.

4. The method of claim 3, wherein the coating material includes a thermal barrier coating (TBC).

* * * * *